US006722995B1

(12) United States Patent
Albers

(10) Patent No.: US 6,722,995 B1
(45) Date of Patent: Apr. 20, 2004

(54) FACILITY FOR PRACTICING A SNOW SPORT

(75) Inventor: Cornelis Johannes Pieter Albers, Amsterdam (NL)

(73) Assignee: Unlimited Snow Indoor B.V., Amsterdam (NL)

( * ) Notice: Subject to any disclaimer, the term of this patent is extended or adjusted under 35 U.S.C. 154(b) by 0 days.

(21) Appl. No.: 10/030,975

(22) PCT Filed: Jul. 14, 2000

(86) PCT No.: PCT/NL00/00497

§ 371 (c)(1),
(2), (4) Date: May 13, 2002

(87) PCT Pub. No.: WO01/05471

PCT Pub. Date: Jan. 25, 2001

(30) Foreign Application Priority Data

Jul. 15, 1999 (NL) ..... 1012601

(51) Int. Cl.[7] ..... A63C 19/10
(52) U.S. Cl. ..... 472/90; 472/92
(58) Field of Search ..... 472/88, 90, 91, 472/92

(56) References Cited

U.S. PATENT DOCUMENTS

| | | | | | |
|---|---|---|---|---|---|
| 3,250,530 | A | * | 5/1966 | Dean et al. | 472/90 |
| 3,801,093 | A | * | 4/1974 | Jones, III | 472/94 |
| 4,172,593 | A | | 10/1979 | Palakanis | |
| 4,790,531 | A | * | 12/1988 | Matsui et al. | 472/90 |
| 4,976,422 | A | * | 12/1990 | Shimamura | 472/90 |
| 5,184,980 | A | * | 2/1993 | Ferris | 472/91 |
| 5,230,218 | A | * | 7/1993 | Clulow | 62/74 |
| 5,327,738 | A | * | 7/1994 | Morioka et al. | 62/74 |
| 5,649,865 | A | * | 7/1997 | Harvey | 472/90 |

FOREIGN PATENT DOCUMENTS

| | | |
|---|---|---|
| DE | 198 24 320 | 12/1999 |
| WO | WO 99/46017 | 9/1999 |

* cited by examiner

*Primary Examiner*—Kien T. Nguyen
(74) *Attorney, Agent, or Firm*—Young & Thompson

(57) ABSTRACT

The facility includes an enclosed space provided with a floor on which a layer of snow can be formed, an apparatus for cooling the space and a device for forming the layer of snow in the space so as to make a predetermined course. The course includes at least one continuous section.

2 Claims, 1 Drawing Sheet

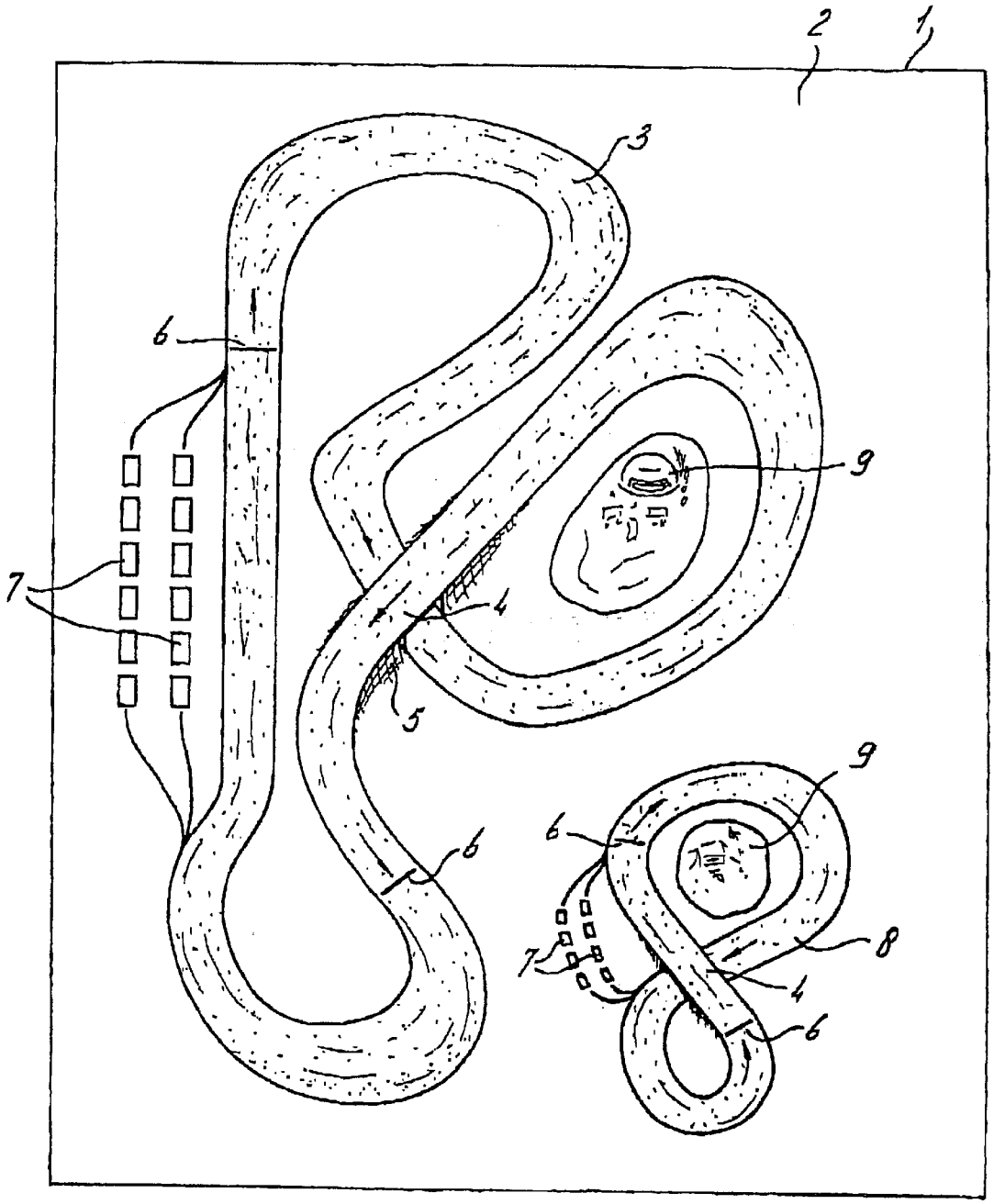
2
1
3
6
9
7
4
5
6
9
6
8
7
4
6

FACILITY FOR PRACTICING A SNOW SPORT

FIELD OF THE INVENTION

The invention relates to a facility for practising a snow sport, comprising an enclosed space provided with a floor on which a layer of snow can be formed, means for cooling the space and means for forming the layer of snow in the said space so as to make a predetermined course.

BACKGROUND OF THE INVENTION

Facilities for practising skiing are known. By way of example, reference is made to the structure which is known from U.S. Pat. No. 4,790,531, in which there is a sloping track which can be covered with a layer of snow. The users make their way to the top of the sloping track and can then ski down. They then have to be transported up by means of a lift.

In itself, a facility of this nature is suitable for practising skiing. Nevertheless, there are a number of drawbacks which make it virtually impossible to use the facility for other snow sports. These restrictions are associated with the fact that the sloping track in fact only allows movement in one direction, downwards. Although it is possible, for example, for a snow scooter to move upwards along the sloping track, the risk of the scooter turning over when taking corners and the like is relatively high for the user. For this reason, the known facility is in fact relatively unsuitable for snow scooters, cross-country skiing and the like, for example.

SUMMARY OF THE INVENTION

Therefore, the object of the invention is to provide a facility which does not have these restrictions. This object is achieved by the fact that the course comprises at least one continuous section.

The continuous section of the course in he facility according to the invention makes it possible to move round on a snow scooter or cart or cross-country skis and also, for example, to hold a competition on such means, The course can be designed in all kinds of different ways, for example with or without crossing points. The crossing points may also be at different levels. It is also possible for slopes to be incorporated in the course. The course may also be in the shape of a ring.

Furthermore, there may be parking places for, for example, snow scooters and, if appropriate, a clearly marked start and finish.

The cooling means can be designed in all kinds of ways, for example by means of floor cooling and/or cooling of the space. In the case of floor cooling used on its own, the snow machines for producing snow have to have a sufficiently high capacity, so that the layer of snow can be maintained at a certain level.

Reference is made to the track for practising roller-skating which is known from U.S. Pat. No. 172,593. This track, which is situated in the open air, is continuous and includes a crossing point at different levels. The track consists of concrete and is of permanent nature. It is not possible to apply any form of truck made from snow.

BRIEF DESCRIPTION OF THE DRAWINGS

The invention will now be explained in more detail with reference to an exemplary embodiment illustrated in the FIGURE.

DETAILED DESCRIPTION OF THE INVENTION

The FIGURE shows the plan of a facility according to the invention. This facility comprises an enclosed space 1, on the floor 2 of which a continuous first course 3 is formed. This course 3 is covered with a layer of snow and comprises a crossing point 4 at different levels, in which slopes 5 are incorporated.

The course 3 comprises a start and finish 6, in such a manner that, for example, a competition can be held.

Next to the course 3 there are a number of parking places or pits 7, at which the snow scooters can be parked, repaired and the like.

A smaller course 8, for example an area for children, is likewise provided with a crossing point 4 at different levels, start and finish 6 and stopping places 7, may also be provided.

In the course it is possible, for example, to incorporate auxiliary features such as a restaurant or bar 9 and the like.

The layer of snow may comprise both snow crystals and/or ice crystals.

The facility according to the invention may be permanent but may also be temporary and/or mobile.

What is claimed is:

1. Facility for practicing a snow sport, comprising an enclosed space (1) provided with a floor (2), on which a layer of snow can be formed, means for cooling the space and means forming the layer of snow in said space so as to make a predetermined course (3), said course (3) comprising a continuous closed and endless course, and the perimeter of the enclosed space (1) being different from the perimeter of the course (3).

2. The facility according to claim 1, wherein said course (3) crosses over itself and in crossing over itself rises from the level of said floor to above said floor and then returns to the level of said floor.

* * * * *